United States Patent [19]

Nall et al.

[11] Patent Number: 4,552,120

[45] Date of Patent: Nov. 12, 1985

[54] BATTING INSTRUCTION SYSTEM

[75] Inventors: Kent J. Nall, 4322 Troup, Kansas City, Kans. 66102; W. Christopher Barteldes, Lawrence, Kans.; David W. Payne, Prairie Village, Kans.; Charles P. Rome, Overland Park, Kans.; Wayne A. Abrams, Kansas City, Kans.

[73] Assignee: Kent J. Nall, Kansas City, Kans.

[21] Appl. No.: 431,817

[22] Filed: Sep. 30, 1982

[51] Int. Cl.[4] ..... F41B 3/04

[52] U.S. Cl. ..... 124/1; 124/50; 124/78; 221/259; 221/277; 273/26 R; 273/26 D

[58] Field of Search ..... 273/30, 26 D, 26 R; 124/4, 6, 10, 49, 50, 78, 79; 221/42, 43, 44, 277, 259

[56] References Cited

U.S. PATENT DOCUMENTS

| | | | |
|---|---|---|---|
| 1,211,738 | 1/1917 | Marty | 273/26 D |
| 1,252,327 | 1/1918 | Dorion | 221/260 |
| 2,288,979 | 7/1942 | Testi | 221/259 |
| 2,566,379 | 9/1951 | Strong | 124/78 |
| 3,003,770 | 10/1961 | Jones | 273/201 |
| 3,248,008 | 4/1966 | Meierjohan | 221/277 |
| 3,306,613 | 2/1967 | Mainers | 273/26 D |
| 3,360,163 | 12/1976 | Fessler | 221/277 |
| 3,399,660 | 9/1968 | Swartout | 221/259 |
| 4,080,950 | 5/1978 | Paulson | 124/1 |
| 4,203,413 | 5/1980 | Hodges | 273/29 A |
| 4,423,717 | 1/1984 | Kahelin | 273/26 D |

FOREIGN PATENT DOCUMENTS

| | | | |
|---|---|---|---|
| 70529 | 6/1915 | Austria | 124/6 |

*Primary Examiner*—Richard C. Pinkham
*Assistant Examiner*—T. Brown
*Attorney, Agent, or Firm*—Schmidt, Johnson, Hovey & Williams

[57] ABSTRACT

The system includes a stance and stride chart adapted to lie flatly on the ground and having indicia thereon indicating home plate and the proper location for a batter's feet as he stands adjacent home plate in preparation for taking a stride during a batting swing. Further included is a ball toss device adapted to be positioned forwardly adjacent the stride chart and operable to loft a ball gently through the strike zone above the plate for hitting by the batter as he completes the swing. A catching net may be positioned forwardly of the chart to collect batted balls. The ball toss device is operable to loft a supply of balls sequentially and at spaced intervals toward the strike zone and has the capability of adjustment for accommodating either hardballs or larger diameter softballs. An adjustment is also provided which enables the loft of the balls being propelled from the device to be varied substantially in order that the device may be used to propel ground balls toward a fielder instead of lofting them toward a batter.

2 Claims, 8 Drawing Figures

7.
8.

BATTING INSTRUCTION SYSTEM

TECHNICAL FIELD

This invention relates to a batting practice and instruction system which is especially beneficial for use in helping young ball players develop proper batting and fielding techniques.

BACKGROUND

Young batters are particularly prone to stride in an improper manner as they attempt to swing at a pitched ball. Coaches have attempted to solve this problem by positioning themselves adjacent the batter and then sequentially lofting balls over the strike zone while observing the batter's actions and then giving appropriate instructions for correction if necessary. However, considerable man power is obviously required to carry out that kind of intensive, personal instruction, and frequently coaches simply do not have the amount of time required; thus the necessary instruction and practice often does not occur.

SUMMARY OF THE PRESENT INVENTION

Accordingly, one important object of the present invention is to provide a batting instruction system which is especially conducive to self-teaching efforts, or by which a coach or other instructor, after initially setting up the system, can thereafter attend to other matters while the batter receives training and instruction with respect to striding and footwork through a chart associated with the system. In this respect it is also an important object of this invention to provide a ball tossing device as part of the system which lofts a series of balls at regular, spaced intervals with an acceptable degree of precision such that, even though passing through different portions of the strike zone, the balls are reliably propelled by the tossing device into the strike zone.

Pursuant to the foregoing, the present invention contemplates the use of a flat, mat-like chart which is adapted to be positioned flatly on the ground and to illustrate a home plate and the outline of footprints showing proper positions for a batting stance and a stride out of the stance in connection with a batting swing. The batter assumes a position beside the chart, and by observing the appropriate markings on the stride chart both before a pitch from the tossing device and after he strides through a batting swing, the batter is taught through repetition to use the proper hitting techniques.

A ball tossing device is positioned forwardly of the stride chart, preferably at an angle thereto, and is operable to toss a series of balls through the strike zone at regular intervals once provided with a supply of balls. The tossing device utilizes a rotary impeller having a resilient periphery of uniform diameter to engage each ball as it is presented to the impeller in a track and to then propel the engaged ball quickly off the track and toward the stride chart in an appropriately lofted manner. By adjusting the position of the impeller relative to the track, accommodations may be made for variations in ball size such as occuring between hardballs and softballs. Furthermore, the track itself may be adjusted appropriately to change the loft on balls which it discharges, thereby providing not only for batting practice, but also for infield practice with ground balls or short flies.

DETAILED DESCRIPTION

Figure 2:
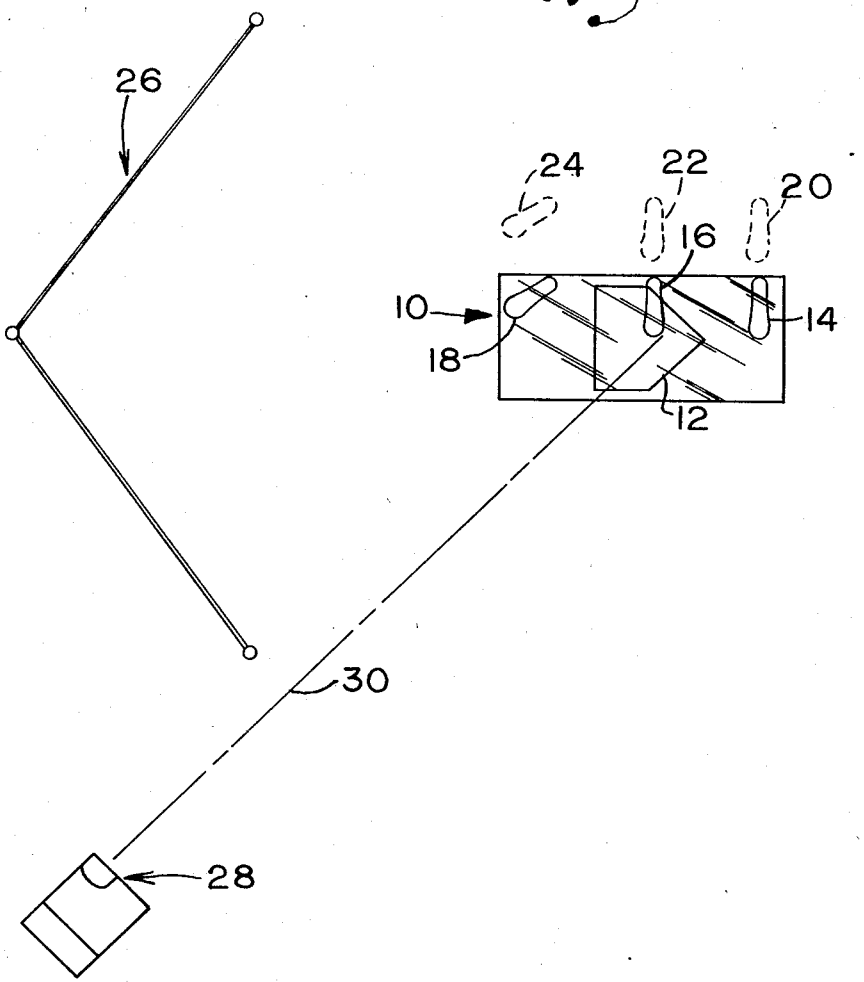
FIG. 2 is a schematic plan view of an instruction system in accordance with the present invention which uses the ball toss of FIG. 1.

FIG. 2 shows the three major components of the system of the present invention. First, a stance and stride chart 10 is provided which is constructed of a suitable flat material such as, for example, a sheet of vinyl or other suitable plastic. The chart 10 is adapted to lie flatly on the ground is provided with indicia on its upper surface representing home plate 12 and footprints 14, 16 and 18. In the illustrated embodiment the chart 10 is arranged for a left-handed batter who will position himself adjacent the chart 10 with his own feet aligned with the footprints 14 and 16, but not superimposed thereon. The batter's footprints are indicated in phantom lines in FIG. 2 and by the numerals 20 and 22. The phantom line footprint 24 then illustrates the proper position for the batter's foot 22 as he strides toward the ball in making a batting swing. Such footprint 24 should be aligned with the stride footprint 18 on the chart 10. In this manner, by carefully noting the position of his own feet relative to the footprints 14, 16 and 18 not only during initially taking a batting stance but also upon then taking a batting stride, the hitter may learn and develop the proper batting techniques. It is contemplated that the reverse side of the chart 10 will be provided with indicia appropriate for a right-handed batter such that the chart 10 need only be flipped over to expose its appropriate side depending upon the type of batter then appearing at the hitting location.

A second major component of the system of the present invention is a catching net 26 of any suitable construction which is adapted to stand on the ground forwardly of the chart 10 in position to intercept balls hit by the batter at the chart 10. The net 26 is suitably foldable or collapsable into a compacted condition such that all components of the system may be conveniently stored and transported.

The third major component of the system comprises a ball tossing device 28 illustrated in FIG. 2 as being positioned forwardly and leftwardly of the chart 10. The device 28 is operable to toss balls generally along the line 30 into and through the imaginary strike zone above the plate 12 of the chart 10.

Figure 4:
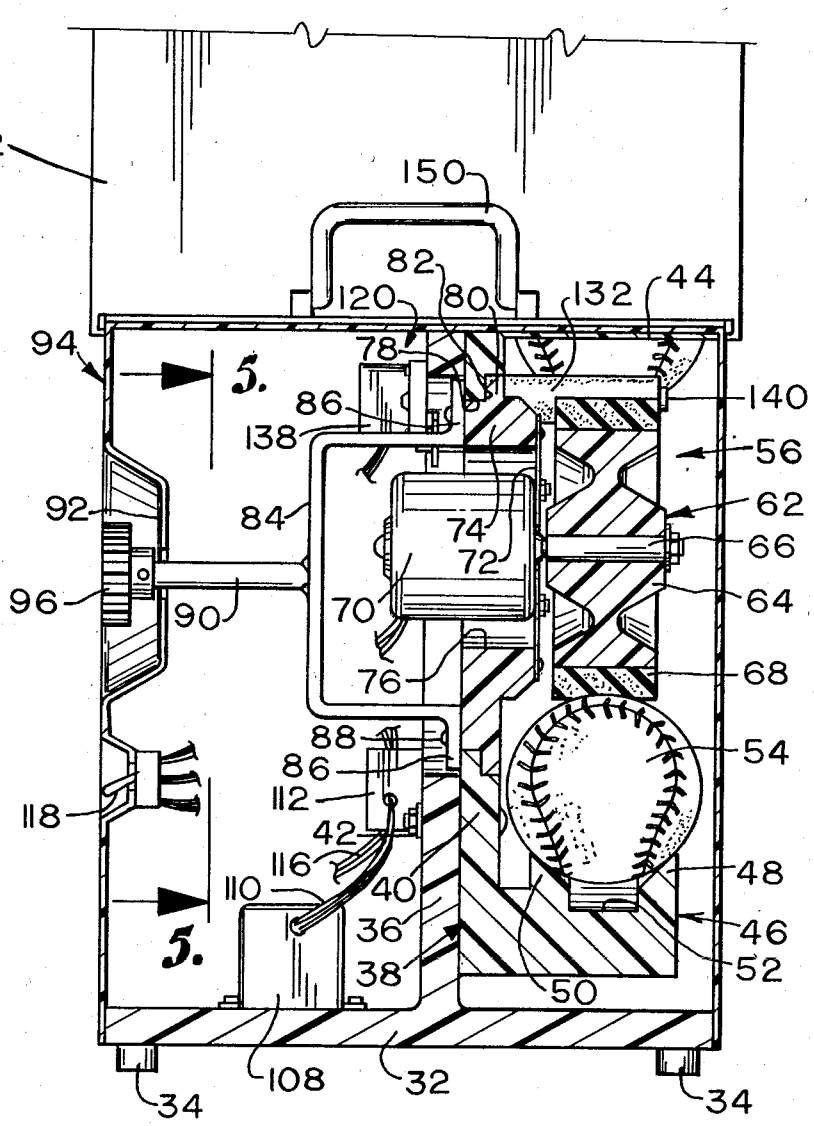
FIG. 4 is a fragmentary, vertical cross-sectional view thereof taken substantially along line 4—4 of FIG. 3.

The tossing device 28 includes a chassis having a base 32 of generally rectangular configuration and from which a plurality of suitable feet 34 project so as to stabilize the device 28 during use. The chassis also includes an upright, generally centrally located support plate 36 integral with and rising upwardly from the base 32. Attached to one side of the plate 36 is a specially configured support member 38 having a flat wall portion 40 butted up against the support plate 36 and through which passes a horizontal pivot pin 42 by which the support member 38 is rendered pivotal relative to the support plate 36 for reasons which will hereinafter be made apparent. As shown perhaps best in FIGS. 3, 5 and 6, the support member 38 is generally quadrant shaped and has an upper, forward extremity defined in part by a web portion 44 projecting from the wall portion 40 at right angles thereto and following the arcuate nature of the upper and forward extremity thereof. At the opposite extreme, the support member 38 is provided with a ball-guiding track 46 positioned outwardly from the plane of the wall portion 40 and having a generally upwardly cupped or arched configuration. The track 46 includes a pair of laterally spaced ball-supporting rails 48 and 50 having a groove 52 therebetween which extend the full length of the track 46 and serve to support and guide a ball during operation such as, for example, the softball 54 illustrated in FIGS. 3 and 4.

Figure 1:
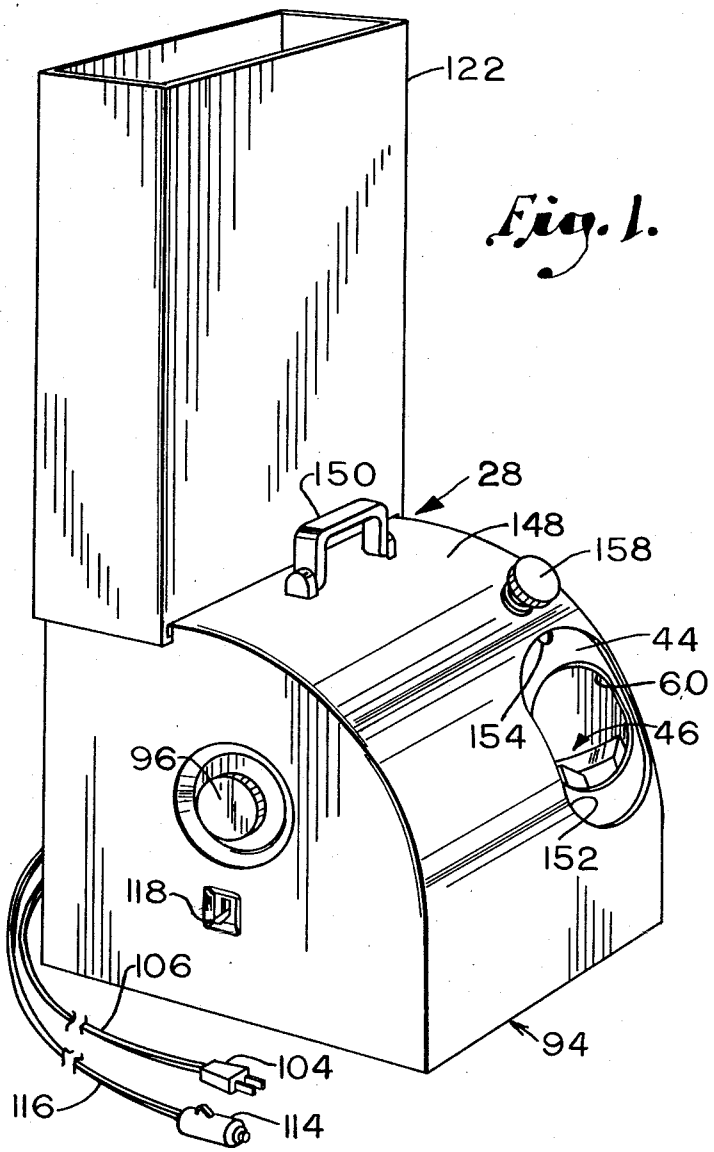
FIG. 1 is a left front perspective view of a ball toss device constructed in accordance with the principles of the present invention.
Figure 3:
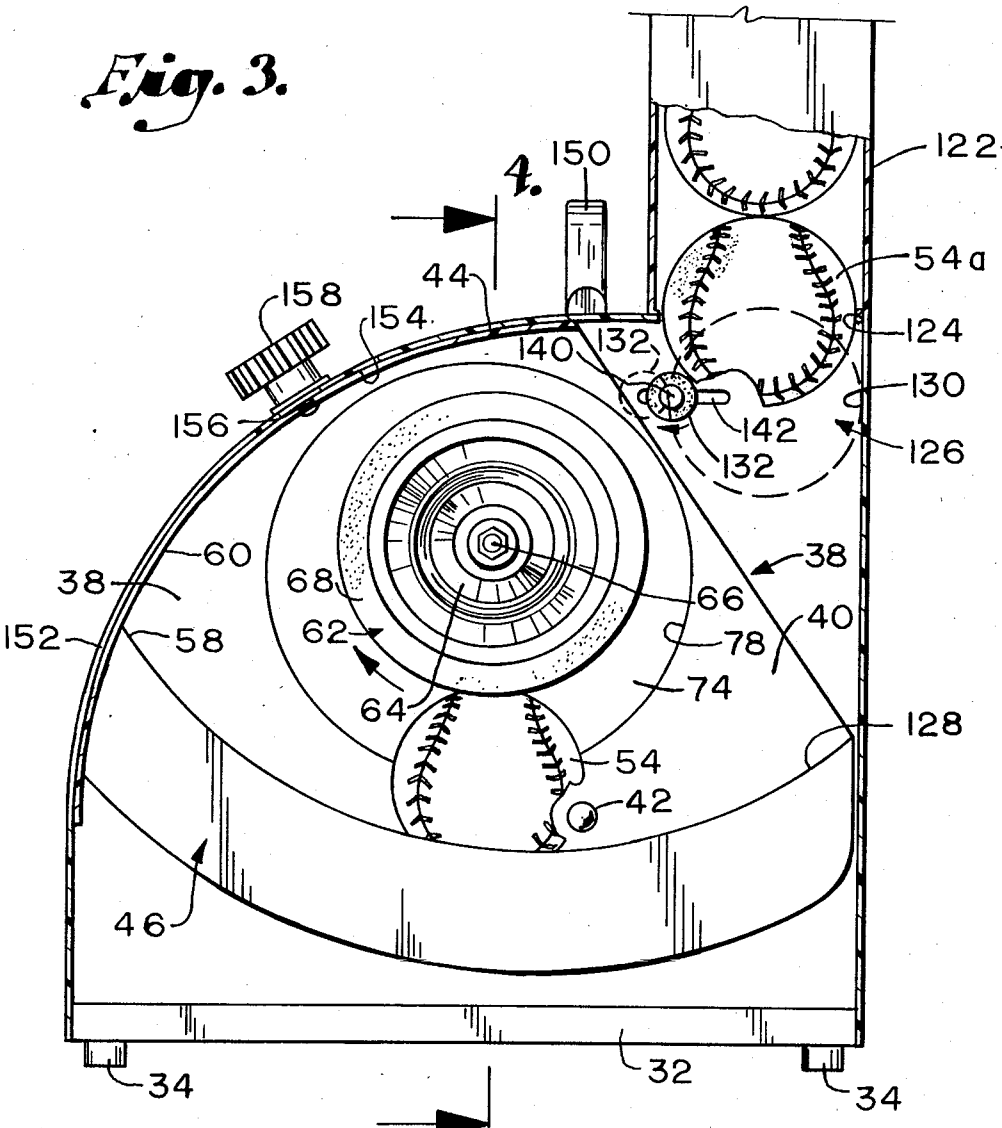
FIG. 3 is an enlarged, fragmentary, vertical cross-sectional view of the tossing device viewed from the opposite direction of that shown in FIG. 1.
Figures 5, 6, 7, 8:
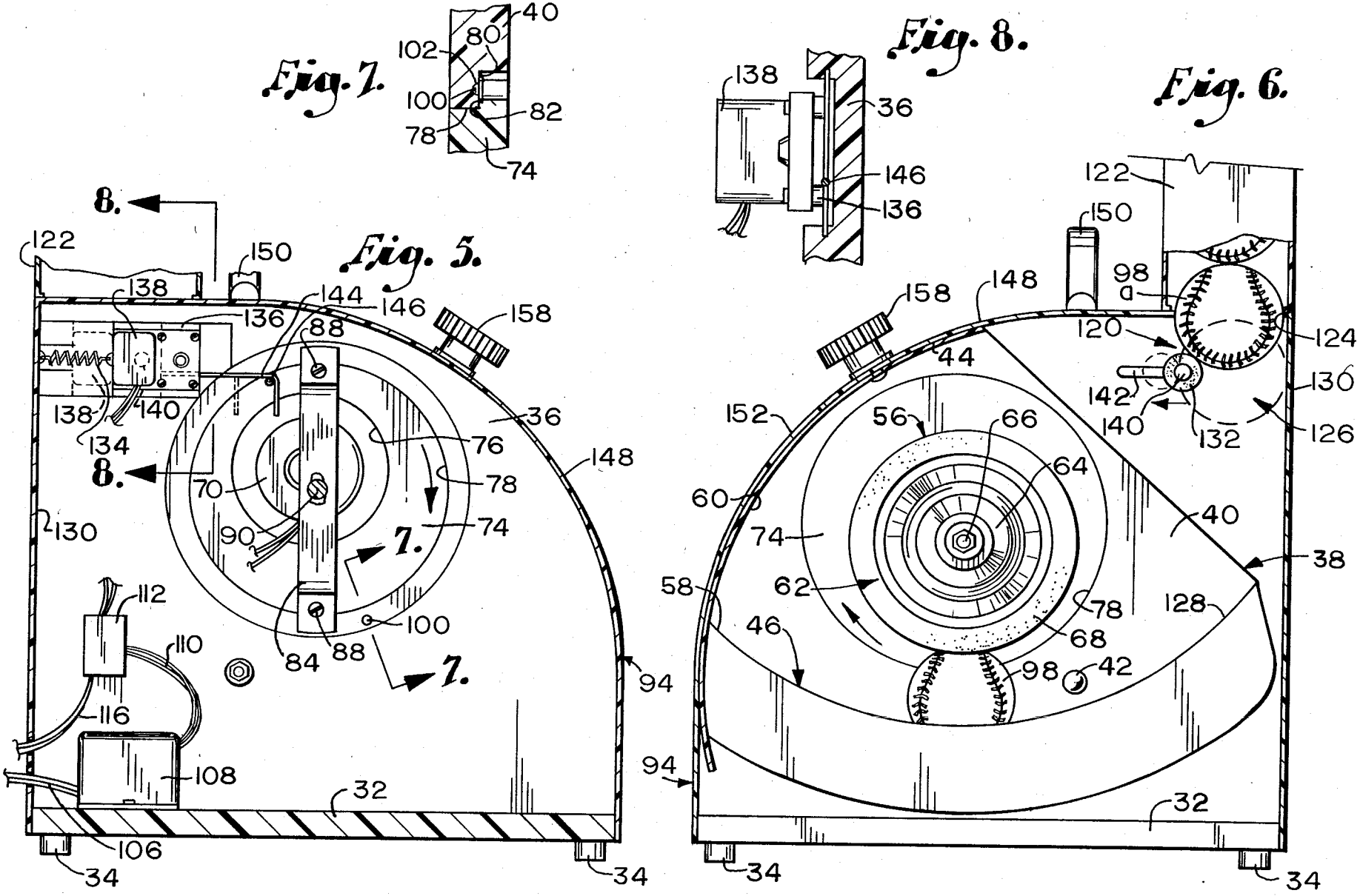
FIG. 5 is a fragmentary, vertical cross-sectional view of the tossing device taken substantially along line 5—5 of FIG. 4.
FIG. 6 is a cross-sectional view of the tossing device similar to FIG. 3 but showing components thereof adjusted for accommodating smaller diameter hardballs.
FIG. 7 is an enlarged, fragmentary detail view of detent structure utilized in releasably holding the impeller of the tossing device in a selected adjusted position for ball size.
FIG. 8 is an enlarged, fragmentary cross-sectional view of ball metering apparatus associated with the tossing device, such view being taken substantially along line 8—8 of FIG. 5.

The device 28 also includes an impeller denoted broadly by the numeral 56 which is operable to engage and propel balls such as the softball 54 along the track 46 and off the discharge end 58 thereof through an outlet 60 in web 44 (FIGS. 1, 3 and 6). The impeller 56 preferably comprises a rotary impelling wheel 62 having a hub 64 fixed to a drive shaft 66 that defines a horizontal axis of rotation of the wheel 62. The periphery of the wheel 62 is preferably defined by a rim or ring 68 of elastomeric material having a surface hardness which will permit same to be depressed resiliently to some extent as it engages the ball 54 presented thereto by the track 46, thereby providing for a firm grip by the wheel 62 on the ball 54 and allowing the distance between the periphery thereof and the track 46 to be such that the ball 54 is slightly squeezed between wheel 62 and the track 46 during operation.

The impeller 56 further includes a direct current electric motor 70 which may be adjustable between two or more operating speeds. A plate 72 attaches the motor 70 to a mount 74 having a bore 76 therethrough and within which the body of the motor 70 is disposed. The mount 74 is, in turn, rotatably carried by the wall portion 40 of the support 38 within a circular aperture 78 having its axis eccentrically disposed with respect to the drive shaft 66 of impeller wheel 62. An annular lip 80 about the periphery of the mount 74 butts against an annular ledge 82 of the bore 78 to retain the mount 74 against movement in a leftward direction viewing FIG. 4, while a generally U-shaped strap 84 has a pair of oppositely out-turned feet 86 which are attached to the mount 74 by screws 88 or the like and overlap the wall portion 40 of support 38 at the bore 78 so as to retain the mount 74 against movement in a rightward direction viewing FIG. 4.

As above mentioned, the axis of the bore 78 is eccentrically disposed with respect to that of drive shaft 66. This is illustrated at one place in FIG. 5, showing in cross-section a shaft 90 which is rigidly affixed to the strap 84 and projects outwardly therefrom through a recess 92 in the housing 94 of device 28, the shaft 90 having its longitudinal axis centered on the axis of the bore 78. A knob 96 fixed to the outer end of the shaft 90 provides a means by which shaft 90 may be manually rotated, hence adjustably rotating the mount 74 within the bore 78 to thereby shift the impeller 56 toward or away from the track 46. This allows for variations in ball sizes such as obtained with a softball 54 in FIGS. 3 and 4 and a hardball 98 in FIG. 6.

FIGS. 5 and 7 illustrate a small, spring-loaded detent 100 between the lip 80 of mount 74 and the ledge 82 of support wall portion 40. The detent 100 is operable to pop into one of two receiving dimples 102 (one only being shown) in the lip 80 at circumferentially spaced positions about the latter corresponding to the softball position for the impeller 56 and the hardball position thereof respectively. Thus, the detent 100 and dimples 102 operate to selectively hold the impeller 56 in its selected position, such holding action being overcome by manual rotation of the knob 96 when adjustment is desired.

As indicated earlier, the motor 70 is electrically powered by direct current. In this regard, it is preferred that provision be made for powering the motor 70 either through plugging into an AC power source with an extension cord or the like, or into a direct current power source such as available through conventional storage batteries. In this regard, as illustrated in FIG. 1, a dual-pronged plug 104 is provided for connecting the tossing device 28 to an alternating current power source. The line 106 from plug 104 leads to a transformer 108 (FIGS. 4 and 5) attached to the base 32 within the housing 94 for the purpose of converting the alternating current in line 106 to direct current. Line 110 from the transformer 108 leads to a junction box 112 from which direct current is distributed to the motor 70 and other electrical components of the device 28 yet-to-be described.

A direct current plug 114 as shown in FIG. 1 has a line 116 which enters the housing 94 and leads to the junction box 112. A switch 118 is suitably connected into the circuit associated with the motor 70 to control activation thereof after either one of the plugs 104 and 114 is plugged into its appropriate power source.

Balls of the selected size and character are delivered to the track 46 and impeller 56 sequentially and at spaced intervals by metering means broadly denoted by the numeral 120. The metering means 120 is supplied by a suitable hopper 122 or the like forming an upward extension of the housing 94 and operable to deliver a continuous supply of balls by gravity to the metering means 120. As illustrated particularly in FIGS. 3 and 6, the metering means 120 is positioned directly below the single ball outlet 124 of the hopper 122 and includes a constricted throat 126 through which the balls must pass in order to reach the receiving end 128 of the track 46 directly therebelow.

The throat 126 is defined in part by a back wall 130 of the housing 94 and, on the other extreme, by a component 132 which may be shifted toward and away from the back wall 130 to effectively open and close the throat 126. Thus, as shown with respect to the softball **54*a* in FIG. 3 the component 132 is in a ball-retaining position thereof as shown in solid lines in that figure, but when shifted leftwardly to its phantom line position is operable to release the ball 54 for gravitation to the receiving end 128 of the track 46. Similarly, the component 132 is shifted between its hardball retaining-position in solid lines in FIG. 6 and its hardball releasing-position shown in phantom lines in that figure so as to retain and release the hardball 98***a* in the same manner as the softball 54*a*.

The component 132 is rotary driven in a clockwise direction viewing FIG. 3 so as to impart a generally downwardly directed, driving force to the ball 54*a* or 98*a* when the latter comes into riding engagement with the upper periphery thereof. Thus, the ball being metered by the throat 126 is urged by the component 132 progressively deeper into the throat 126, and as the ball moves accordingly, it exerts a reaction force against the component 132 to shift the latter leftwardly to its appropriate ball-releasing position.

As illustrated in FIG. 5, an extension spring 134 yieldably biases the component 132 toward its ball-retaining position such that component 132 is returned to its ball-retaining position after each passage of a ball. The spring 134 is connected between the back wall 130 of the housing 94 on the one hand and a slide 136 on the other hand which carries a small electrical motor 138 having an output shaft 140 to which the component 132 is attached for rotation thereby. The slide 136 moves in a horizontal direction between extreme positions corresponding to the releasing and retaining positions of the component 132, there being an elongated, horizontal slot 142 in the support plate 36 clearing the output shaft 140 of the motor 138 during its horizontal movement with the slide 136.

As illustrated in FIG. 5, a coupling is provided between the mount 74 for the impeller 56 and the shiftable throat component 132 in order to adjust the dimensions of the throat 126 for the appropriate sized ball contained in the hopper 122. In this respect, the mount 74 is provided with a projection 144 on the back side thereof adapted to be engaged and releasably retained by a hook-like catch 146 projecting outwardly from one end of the slide 136 and fixed thereto for movement therewith. The position of the projection 144 on the mount 74 is so selected as to cause the projection 144 to engage and pull the catch 146 to its solid line position shown in FIG. 5 from the phantom line position thereof as the mount 74 is rotated from its hardball position to its softball position in a clockwise direction viewing FIG. 5. On the other hand, when the mount 74 is rotated in a counterclockwise direction viewing FIG. 5 to place the impeller 56 in condition for smaller diameter hardballs, the projection 144 is rotated out of the catch 146, allowing the tension spring 134 to pull the slide 136 leftwardly to the phantom line position thereof illustrated in FIG. 5 and corresponding to the condition of things shown in solid lines in FIG. 6.

The housing 94 is provided with an arcuate front wall 148 to which may be attached a convenient carrying-handle 150 if desired. The front wall 148 has an enlarged elliptically-shaped opening 152 therein which overlies a portion of the web 44 so as to permit the discharge outlet 60 thereof to be brought into alignment therewith as illustrated for example in FIG. 1. Because of the fact that the support 38 of which the track 46 is a part can be pivoted bodily about the horizontal pivot 42, the track 46 and hence also the outlet 60 can be shifted lengthwise relative to the opening 152 in opposite directions shown in FIG. 1. Thus, as may be noted by comparing FIGS. 3 and 4, the track 46 may be selectively adjusted to raise or lower the discharge end 58 thereof, hence adjusting the loft of balls propelled out of the device 28. A relatively narrow, elongated slot 154 in the web 44 just above the outlet 60 receives the shank 156 (FIG. 3) of a retaining knob 158 outside the housing 94 on front wall 148. When the knob 158 is rotated in one direction to slightly release the shank 156 which passes through a relatively close diameter hole (not shown) in the front wall 148, the support member 38 and hence the track 46 may be rocked about the pivot 142 to the extent permitted by the shank 156 in slot 154. When the knob 158 is then tightened-down, the web 44 is clamped tightly against the front wall 148 to retain the support member 38 in its selected position.

OPERATION

The general manner of use of the instruction and practice system of the present invention is believed apparent from the foregoing description. Suffice it to point out, therefore, that with the tossing device 28 positioned in the manner illustrated in FIG. 2, balls will be successively tossed generally along the line 30 at spaced intervals into the strike zone above the plate 12. By noting the footprint indicia 14, 16 and 18 on the chart 10, the batter can assume the proper stance as he awaits the toss from device 28 and can then carry through with the proper stride as he completes a batting swing.

The coach or batter himself loads the hopper 122 with a supply of selected balls and, depending upon whether a hardball or softball is to be used, he operates the control knob 96 in the appropriate direction to set the impeller 56 accordingly. Such rotation of the knob 96 causes the mount 74 to rotate within the aperture 78 of support 38, and because of the eccentric relationship between the axis of such aperture 78 and the drive shaft 66 of the impeller wheel 62, the impeller 56 is displaced upwardly or downwardly with respect to the track 46 into hardball or softball positions. The loft of the track 46 may be adjusted by appropriately rotating the knob 158 to release the web 44 and permit the support member 38 to be rocked about its pivot 42, whereupon rotating the knob 158 in the opposite direction then clamps the web 44 in the selected position.

With the appropriate plug 104 or 114 inserted into its receptacle (not shown), the switch 118 may then be thrown to activate the impeller motor 70 and the metering motor 138. Balls from the hopper 122 are sequentially presented to the control throat 126, and as the rotating component 132 urges the lowermost ball projecting through the hopper outlet 124 toward and through the throat 126, the ball itself progressively shifts the component 132 leftwardly viewing FIGS. 3 and 6 to thus progressively relax or open up the throat 126. Consequently, after a certain elapsed period of time, the throat 126 will be fully opened, permitting the ball to drop down to the receiving end 128 of the track 46, whereupon the component 132 is snapped back to its throat-closing position by the spring 134 to preclude passage of the next ball through the throat 126 until the usual time interval has elapsed.

As the ball drops into the track 46 it rides on the rails 48 and 50 and becomes engaged at its periphery by the rotating impeller wheel 62. The wheel 62 presses the ball against the track 46 and imparts momentum thereto to propel the same off the discharge end 58 of the track 46 and out through the outlet 60 and the opening 152 toward the batter as aforesaid. This sequence of events is repeated until the supply of balls within the hopper 122 is depleted, whereupon the hopper 122 may be restocked with a supply of balls if desired.

It is to be noted that while the device 28 has particular utility in connection with the stride and stance chart 10, the loft adjustment provided for the track 46 makes the device 28 also useable in other ways such as, for example, tossing short flies or propelling ground balls at an infielder when the track 46 is set for low-loft as illustrated in FIG. 6. Thus, it should be readily apparent that the tossing device 28 presents a remarkably useful tool for aiding in the instruction and schooling of young ball players and the like.

We claim:

1. A ball toss device for sequentially lofting baseballs or the like at spaced intervals toward a target area such as home plate, said device comprising:

a ball-guiding track having a ball-receiving end and a ball-discharging end;

a rotary impeller adjacent said track and between said opposite ends thereof in disposition for engaging a ball presented thereto in the track and for thereupon propelling the same off said discharge end of the track into the air; and means for successively delivering a supply of balls to said receiving end of the track at a metered rate of delivery, said delivering means including a throat through which the balls must pass as they approach said track, said throat having a lateral component thereof shiftable between a first position retaining a ball against passage to the track and a second position releasing the ball to the track, said component being provided with means yieldably biasing the same toward said retaining position thereof, said component being rotatively driven in a direction to engage the periphery of a ball retained by the throat and urge the same through the throat, the reaction force caused by such urging movement by the component being sufficient to progressively shift the component to said releasing position against the action of said yieldable biasing means.

2. A ball toss device as claimed in claim 1, wherein said impeller is mounted for adjusting movement toward and away from said track to accommodate balls of different sizes, said impeller having means coupling the same with said component for adjusting the position of the latter in response to adjustment of the position of the impeller.

* * * * *